US012365956B2

(12) United States Patent
Yoshimoto

(10) Patent No.: US 12,365,956 B2
(45) Date of Patent: Jul. 22, 2025

(54) METAL-STRIP RAPID COOLING APPARATUS, METAL-STRIP RAPID COOLING METHOD, AND METHOD OF PRODUCING METAL STRIP PRODUCT

(71) Applicant: JFE Steel Corporation, Tokyo (JP)

(72) Inventor: Soshi Yoshimoto, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 688 days.

(21) Appl. No.: 17/765,236

(22) PCT Filed: Sep. 18, 2020

(86) PCT No.: PCT/JP2020/035571
§ 371 (c)(1),
(2) Date: Mar. 30, 2022

(87) PCT Pub. No.: WO2021/065583
PCT Pub. Date: Apr. 8, 2021

(65) Prior Publication Data

US 2022/0349018 A1 Nov. 3, 2022

(30) Foreign Application Priority Data

Sep. 30, 2019 (JP) ..... 2019-178175

(51) Int. Cl.
*C21D 8/02* (2006.01)
*C23C 2/00* (2006.01)
(Continued)

(52) U.S. Cl.
CPC ..... *C21D 8/0236* (2013.01); *C21D 8/0205* (2013.01); *C23C 2/0038* (2022.08); *C23C 2/0224* (2022.08); *C23C 2/29* (2022.08)

(58) Field of Classification Search
None
See application file for complete search history.

(56) References Cited

U.S. PATENT DOCUMENTS

2019/0323106 A1 10/2019 Ebner et al.

FOREIGN PATENT DOCUMENTS

CN 101247902 A 8/2008
CN 101374613 A1 2/2009
(Continued)

OTHER PUBLICATIONS

International Search Report dated Dec. 1, 2020, of corresponding International Application No. PCT/JP2020/035571, along with an English translation.

(Continued)

*Primary Examiner* — Anthony M Liang
(74) *Attorney, Agent, or Firm* — DLA Piper LLP (US)

(57) ABSTRACT

A metal-strip rapid cooling apparatus includes a cooling fluid ejection device including one set of nozzles or a plurality of sets of nozzles arranged in a horizontal direction, and configured to eject a cooling fluid onto the metal strip from both sides of the metal strip; cooling fluid removing rolls configured to remove a remaining fluid from the metal strip onto which the cooling fluid has been ejected; and movable masking plates on both sides of a metal strip pass line along which the metal strip passes, the movable masking plates each disposed between the metal strip pass line and the nozzles, and configured to move in the horizontal direction to adjust a cooling start position and control a distance from the cooling start position to the cooling fluid removing rolls, the cooling start position positioned such that the metal strip starts to be cooled with the cooling fluid.

8 Claims, 4 Drawing Sheets

(51) Int. Cl.
*C23C 2/02* (2006.01)
*C23C 2/28* (2006.01)

(56) References Cited

FOREIGN PATENT DOCUMENTS

| | | | |
|---|---|---|---|
| CN | 101622083 | A | 1/2010 |
| CN | 110050077 | A | 7/2019 |
| DE | 40 09 868 | A1 | 10/1991 |
| DE | 202015104565 | U1 | 10/2015 |
| EP | 1 908 535 | A1 | 4/2008 |
| EP | 1 944 099 | A1 | 7/2008 |
| EP | 2 116 313 | A1 | 11/2009 |
| JP | S5852416 | A | 3/1983 |
| JP | 58-153733 | A | 9/1983 |
| JP | 59-153843 | A | 9/1984 |
| JP | 60-194022 | A | 10/1985 |
| JP | S61-119623 | A | 6/1986 |
| JP | 64-68427 | A | 3/1989 |
| JP | H07-252538 | A | 10/1995 |
| JP | 2000-192146 | A | 7/2000 |
| JP | 2001-353515 | A | 12/2001 |
| JP | 2008-19505 | A | 1/2008 |
| JP | 2009-144189 | A | 7/2009 |
| JP | 2012-51013 | A | 3/2012 |
| JP | 5991282 | B2 | 9/2016 |
| JP | 2018-053296 | A | 4/2018 |
| JP | 2019-90106 | A | 6/2019 |

OTHER PUBLICATIONS

Japanese Office Action dated Feb. 8, 2022, of counterpart Japanese Application No. 2021-509932, along with a Concise Statement of Relevance of Office Action in English.

Office Action dated Jan. 4, 2024, of counterpart Korean Patent Application No. 10-2022-7010186, along with a Concise Statement of Relevance of Office Action in English.

Office Action dated Feb. 22, 2023, of counterpart Chinese Patent Application No. 202080067935.5, along with a Concise Explanation of Relevance in English.

Communication Pursuant to Article 94(3) EPC dated Sep. 11, 2023, of counterpart European Patent Application No. 20 871 593.8.

Extended European Search Report dated Sep. 9, 2022, of counterpart European Patent Application No. 20871593.8.

Office Action dated Apr. 14, 2025, from counterpart European Application No. 20871593.8.

METAL-STRIP RAPID COOLING APPARATUS, METAL-STRIP RAPID COOLING METHOD, AND METHOD OF PRODUCING METAL STRIP PRODUCT

TECHNICAL FIELD

This disclosure relates to a rapid cooling apparatus and a rapid cooling method by which, in a continuous annealing system where a metal strip is annealed while being continuously conveyed or in a hot-dip galvanizing system where a metal strip is coated while being continuously conveyed, the temperature of the metal strip after rapid cooling can be controlled with a very high degree of freedom, and also relates to a method of producing a metal strip product.

BACKGROUND

In production of a metal strip (metal strip product) such as a steel strip, the metal strip is cooled after heating to, for example, induce phase transformation to enhance the properties of the material. Such cooling takes place in a continuous annealing system where a metal strip is annealed while being continuously conveyed or in a hot-dip galvanizing system where a metal strip is coated while being continuously conveyed.

In the automobile industry which aims to achieve both weight reduction and collision safety of automobile bodies, there has been an increased demand in recent years for thin, high tensile strength steel strips. In producing a high tensile strength steel strip, a technique of rapidly cooling a steel strip is important. A water quenching method is known as a technique that provides the highest cooling rate of cooling a steel strip. The water quenching method involves immersing a heated steel strip in water and, at the same time, ejecting cooling water to the steel strip from a quenching nozzle installed in water to rapidly cool the steel strip. In rapid cooling of a steel strip, the temperature of the steel strip after rapid cooling is controlled to improve mechanical characteristics of the steel strip. Specifically, the ductility of the steel strip can be improved. Various techniques have been proposed as steel-strip rapid cooling methods.

For example, Japanese Unexamined Patent Application Publication No. 59-153843 discloses a technique in which, with slit nozzles arranged in multiple rows in immersion water and spaced apart in the travel direction of a metal strip, a jet of cooling water colliding with the cooled surface of the metal strip is allowed to flow out through gaps between nozzles toward the back of the nozzles so that the metal strip is uniformly cooled in the width direction. Japanese Patent No. 5991282 discloses a technique in which in a vertical path along which a steel strip is moved upward, rapid heating is performed after rapid cooling to keep the finish cooling temperature constant. Japanese Unexamined Patent Application Publication No. 2008-19505 discloses a technique in which a steel strip is immersed in an ionic liquid at 150° C. to 300° C. in an immersion tank to control the finish cooling temperature. Japanese Unexamined Patent Application Publication No. 58-153733 discloses a technique involving passing a strip in a horizontal or slightly inclined state in a section of a predetermined length, and bringing a jet of cooling fluid into contact with the lower surface of the strip to cool the strip from one side. Japanese Unexamined Patent Application Publication No. 60-194022 discloses a technique in which the ejection of cooling liquid onto the lower surface of a strip is blocked in the strip width direction and/or line direction to adjust the effective cooling width and/or effective cooling length of the strip. Japanese Unexamined Patent Application Publication No. 2001-353515 discloses a technique involving using a water ejection device and an air ejection device disposed above a steel sheet to remove remained water on the upper surface of the steel sheet. Japanese Unexamined Patent Application Publication No. 2012-51013 discloses a technique involving using a wiping device disposed upstream of a cooling apparatus on the entry side and a wiping device disposed downstream of the cooling apparatus on the exit side to remove remained water on the upper surface of a steel sheet.

The method described in JP '843 has a problem in that since the temperature of the steel strip after rapid cooling is equal to the water temperature, the finish cooling temperature cannot be controlled. The technique described in JP '282 has a problem in that since gravity causes water to leak from rolls in the lower part of the cooling apparatus, the cooling start position and the finish cooling temperature cannot be controlled. The method described in JP '505 has a problem in that the ionic liquid used to control the finish cooling temperature is much more expensive than water. There is therefore a demand for developing techniques that are capable of controlling the finish cooling temperature without using a such special liquid.

The methods described in JP '733 or JP '022 have a problem in that since water remains upstream of the cooling apparatus on the entry side and downstream of the cooling apparatus on the exit side, the cooling start position and the finish cooling temperature cannot be controlled. Also, the cooling performed only on the lower surface causes a temperature difference between the upper and lower surfaces. The method described in JP '515 or JP '013 requires ejection of high-pressure water to remove remained water. Since ejection of wiping water lowers the temperature of the steel strip to the water temperature, the finish cooling temperature cannot be controlled.

It could therefore be helpful to provide a rapid cooling apparatus and a rapid cooling method by which, in a continuous annealing system where a metal strip (e.g., steel strip) is annealed while being continuously conveyed or in a hot-dip galvanizing system where a metal strip is coated while being continuously conveyed, the temperature of the metal strip after rapid cooling can be controlled with a very high degree of freedom, and a method of producing a metal strip product.

SUMMARY

We thus provide:

[1] A metal-strip rapid cooling apparatus is a rapid cooling apparatus configured to cool a metal strip while conveying the metal strip in a horizontal direction. The metal-strip rapid cooling apparatus includes a cooling fluid ejection device including one set of nozzles or a plurality of sets of nozzles arranged in the horizontal direction, the nozzles being configured to eject a cooling fluid onto the metal strip from both sides of the metal strip; cooling fluid removing rolls configured to remove a remained fluid from the metal strip onto which the cooling fluid has been ejected; and movable masking plates disposed on both sides of a metal strip pass line along which the metal strip passes, the movable masking plates each being disposed between the metal strip pass line and the nozzles, the movable masking plates being configured to move in the horizontal direction to adjust a cooling start position and control a distance from the cooling start position to the cooling fluid removing rolls, the cooling start position being a position at which the metal strip starts to be cooled with the cooling fluid.

[2] The metal-strip rapid cooling apparatus according to [1] further includes gas ejection nozzles disposed on an exit side of the cooling fluid removing rolls.

[3] In the metal-strip rapid cooling apparatus according to [1] or [2], the movable masking plates each have a gas ejection nozzle attached thereto.

[4] In the metal-strip rapid cooling apparatus according to any one of [1] to [3], an angle formed by the metal strip and an axial direction of each of the nozzles ejecting the cooling fluid is greater than or equal to 10° and less than or equal to 60°.

[5] A metal-strip rapid cooling method is a rapid cooling method of cooling a metal strip by ejecting a cooling fluid from a plurality of nozzles onto surfaces of the metal strip being continuously conveyed in a horizontal direction. The metal-strip rapid cooling method includes, while removing a remained fluid on the metal strip using cooling fluid removing rolls, adjusting a cooling start position using movable masking plates to control a distance from the cooling start position to the cooling fluid removing rolls, the cooling start position being a position at which the metal strip starts to be cooled with the cooling fluid.

[6] In the metal-strip rapid cooling method according to [5], the distance from the cooling start position of the metal strip to the cooling fluid removing rolls is set on the basis of a line speed of the metal strip, a cooling start temperature, a target finish cooling temperature, and a cooling rate of the metal strip.

[7] In the metal-strip rapid cooling method according to [6], when the line speed of the metal strip is v (mm/s), the cooling start temperature is $T_1$ (° C.), the target finish cooling temperature is $T_2$ (° C.), and the cooling rate of the metal strip is CV (° C./s), the distance b (mm) from the cooling start position of the metal strip to the cooling fluid removing rolls is expressed by the following equation:

$$b=(T_1-T_2)v/CV.$$

[8] In the metal-strip rapid cooling method according to [5], the distance from the cooling start position of the metal strip to the cooling fluid removing rolls is set on the basis of a line speed of the metal strip, a cooling start temperature, a target finish cooling temperature, cooling conditions, and a thickness of the metal strip.

[9] In the metal-strip rapid cooling method according to [8], when the line speed of the metal strip is v (mm/s), the cooling start temperature is $T_1$ (° C.), and the target finish cooling temperature is $T_2$ (° C.), the distance b (mm) from the cooling start position of the metal strip to the cooling fluid removing rolls is expressed by the following equation using a constant α (° C.·mm/s) determined by the cooling conditions and the thickness t (mm) of the metal strip:

$$b=(T_1-T_2)vt/\alpha.$$

[10] A method of producing a metal strip product includes performing rapid cooling using the rapid cooling method according to any one of [5] to [9] to produce a metal strip product.

[11] In the method of producing a metal strip product according to [10], the metal strip product is any one of a high-strength cold-rolled steel strip, a hot-dip galvanized steel strip, an electrogalvanized steel strip, and an alloyed hot-dip galvanized steel strip.

We thus make it possible that in a continuous annealing system where a metal strip is annealed while being continuously conveyed or in a hot-dip galvanizing system where a metal strip is coated while being continuously conveyed, the temperature of the metal strip after rapid cooling can be controlled with a very high degree of freedom.

REFERENCE SIGNS LIST

Figure 1:
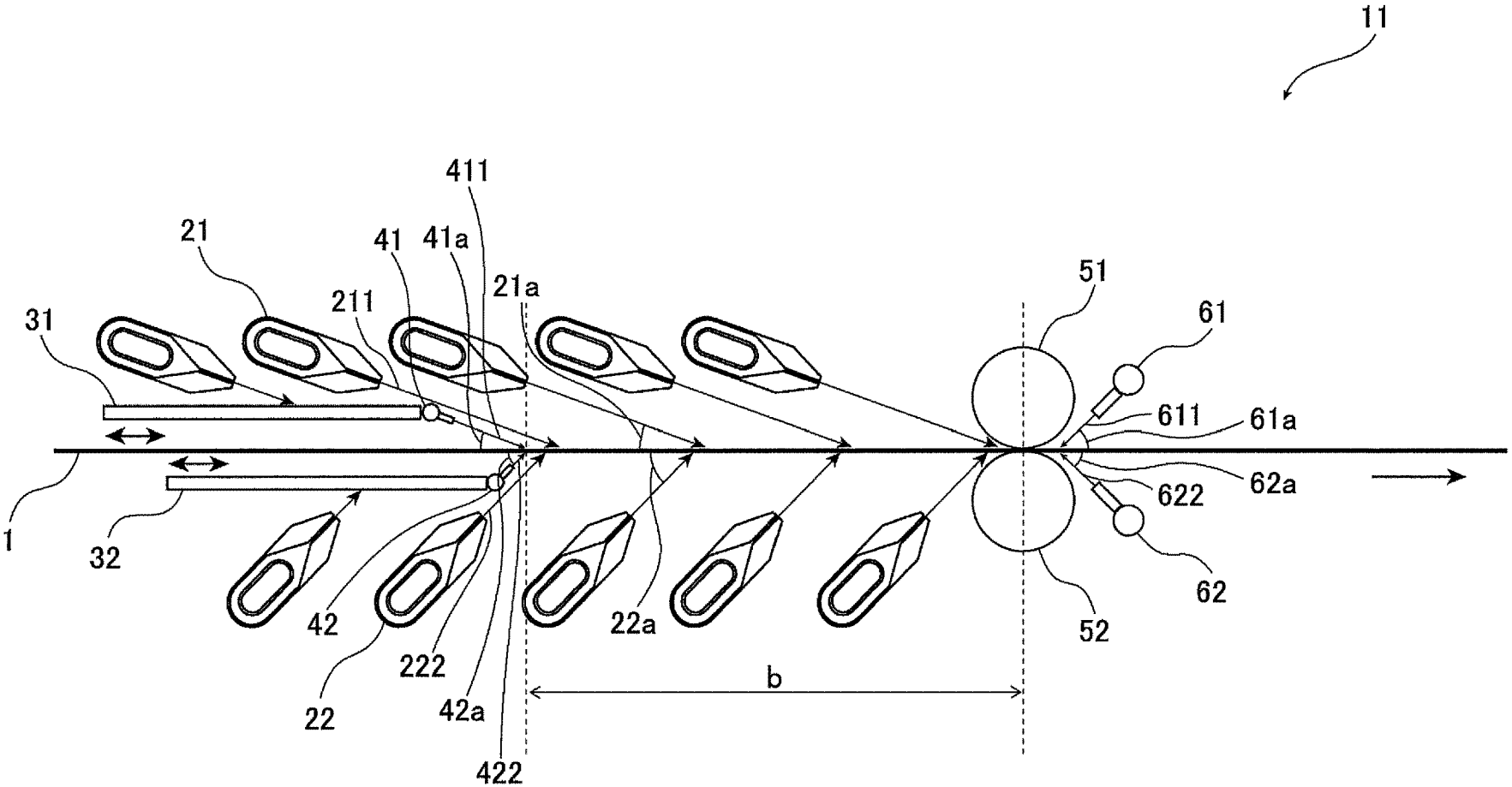
FIG. 1 is a diagram illustrating our rapid cooling apparatus.

1: metal strip
11: metal-strip rapid cooling apparatus
21: upper cooling fluid ejection nozzle (cooling fluid ejection device)
211: cooling fluid ejected from upper cooling fluid ejection nozzle
22: lower cooling fluid ejection nozzle (cooling fluid ejection device)
222: cooling fluid ejected from lower cooling fluid ejection nozzle
**21*a***: acute angle of angles formed by axial direction of upper cooling fluid ejection nozzle (cooling fluid ejection direction) and metal strip
**22*a***: acute angle of angles formed by axial direction of lower cooling fluid ejection nozzle (cooling fluid ejection direction) and metal strip
31: upper movable masking plate (movable masking plate)
32: lower movable masking plate (movable masking plate)
41: entry-side upper gas ejection nozzle (gas ejection nozzle)
411: gas ejected from entry-side upper gas ejection nozzle
42: entry-side lower gas ejection nozzle (gas ejection nozzle)
422: gas ejected from entry-side lower gas ejection nozzle
**41*a***: acute angle of angles formed by axial direction of entry-side upper gas ejection nozzle (gas ejection direction) and metal strip
**42*a***: acute angle of angles formed by axial direction of entry-side lower air ejection nozzle (gas ejection direction) and metal strip
51: upper cooling fluid removing roll (cooling fluid removing roll)
52: lower cooling fluid removing roll (cooling fluid removing roll)
61: exit-side upper gas ejection nozzle (gas ejection nozzle)
611: gas ejected from exit-side upper gas ejection nozzle
62: exit-side lower gas ejection nozzle (gas ejection nozzle)
622: gas ejected from exit-side lower gas ejection nozzle
**61*a***: acute angle of angles formed by axial direction of exit-side upper gas ejection nozzle (gas ejection direction) and metal strip

62*a*: acute angle of angles formed by axial direction of exit-side lower gas ejection nozzle (gas ejection direction) and metal strip b: cooling length (distance from cooling start position of metal strip to cooling fluid removing rolls)

DETAILED DESCRIPTION

We discovered the phenomena discussed below. By cooling in water, the temperature of the metal strip after rapid cooling is made equal to the water temperature. Cooling needs to be performed in air. In that instance, rapid cooling of the metal strip does not necessarily require immersion of the metal strip in water. For example, by ejecting a sufficient amount of water from nozzles, a cooling capacity equivalent to that obtained by ejection in water is achieved. In a vertical path along which a steel strip is moved downward or in a vertical path along which a steel strip is moved upward, even when water is removed in the lower part of the cooling apparatus, gravity causes water to leak in the lower part of the cooling apparatus. Accordingly, cooling needs to be performed in a horizontal path along which a steel strip is moved in the horizontal direction. In that instance, cooling performed only on the lower surface causes a temperature difference between the upper and lower surfaces. Therefore, the cooling needs to be performed on both the upper and lower surfaces. When wiping water of high pressure is used, the temperature of the steel strip is lowered to the water temperature. It is most desirable that rolls and gas ejection nozzles such as air nozzles be used to remove water. For cost reduction, it is necessary to be able to control the finish cooling temperature with, for example, water, without using a special ionic liquid.

Examples reflecting our discoveries as discussed above will now be described on the basis of the drawings.

FIG. 1 is a diagram illustrating a metal-strip rapid cooling apparatus 11. The metal-strip rapid cooling apparatus 11 is applicable to a cooling system disposed on the exit side of a soaking section of a continuous annealing furnace, and a cooling system disposed on the exit side of a hot-dip galvanizing bath of a hot-dip galvanizing system.

The metal-strip rapid cooling apparatus 11 includes upper cooling fluid ejection nozzles 21 (cooling fluid ejection device) configured to eject a coolant (cooling fluid) 211 such as water or alcohol from the upper side of a metal strip 1 continuously conveyed in a horizontal direction (hereinafter also referred to as a longitudinal direction) onto the metal strip 1 for rapid cooling. The metal-strip rapid cooling apparatus 11 also includes lower cooling fluid ejection nozzles 22 (cooling fluid ejection device) configured to eject a coolant (cooling fluid) 222 such as water or alcohol from the lower side of the metal strip 1 continuously conveyed in the horizontal direction onto the metal strip 1 for rapid cooling. The metal-strip rapid cooling apparatus 11 includes one set of nozzles 21 and 22 or a plurality of sets of nozzles 21 and 22 arranged in the horizontal direction. The metal-strip rapid cooling apparatus 11 includes an upper movable masking plate 31 (movable masking plate) configured to move in the horizontal direction and disposed between the upper cooling fluid ejection nozzles 21 and a metal strip pass line along which the metal strip 1 passes. The upper movable masking plate 31 is configured to adjust a cooling start position at which the metal strip 1 starts to be cooled with the cooling fluid (e.g., the position at which jet flows from an entry-side upper gas ejection nozzle 41 and an entry-side lower gas ejection nozzle 42, described below, collide with the metal strip 1) to control the distance from the cooling start position to an upper cooling fluid removing roll described below. The metal-strip rapid cooling apparatus 11 also includes a lower movable masking plate 32 (movable masking plate) configured to move in the horizontal direction and disposed between the lower cooling fluid ejection nozzles 22 and the metal strip pass line along which the metal strip 1 passes. The lower movable masking plate 32 is configured to adjust the cooling start position at which the metal strip 1 starts to be cooled with the cooling fluid to control the distance from the cooling start position to a lower cooling fluid removing roll described below. The metal-strip rapid cooling apparatus 11 includes an upper cooling fluid removing roll 51 (cooling fluid removing roll) disposed on the exit side of the upper cooling fluid ejection nozzles 21 and configured to remove a remained fluid such as remained water or remained alcohol on the upper surface of the metal strip 1 onto which the cooling fluid has been ejected. The metal-strip rapid cooling apparatus 11 also includes a lower cooling fluid removing roll 52 (cooling fluid removing roll) disposed on the exit side of the lower cooling fluid ejection nozzles 22 and configured to remove remaining fluid such as remaining water or remaining alcohol on the lower surface of the metal strip 1 onto which the cooling fluid has been ejected.

The metal-strip rapid cooling apparatus 11 may include an entry-side upper gas ejection nozzle 41 (gas ejection nozzle) attached to the upper movable masking plate 31 and configured to eject a gas 411 such as air or nitrogen from the upper side on the entry side of the metal strip 1 onto the metal strip 1. The entry-side upper gas ejection nozzle 41 is configured to prevent the remained fluid on the upper surface of the metal strip 1 from flowing back to the position of the upper movable masking plate 31. The metal-strip rapid cooling apparatus 11 may also include an entry-side lower gas ejection nozzle 42 (gas ejection nozzle) attached to the lower movable masking plate 32 and configured to eject a gas 422 such as air or nitrogen from the lower side on the entry side of the metal strip 1 onto the metal strip 1. The entry-side lower gas ejection nozzle 42 is configured to prevent the remained fluid on the lower surface of the metal strip 1 from flowing back to the position of the lower movable masking plate 32. The metal-strip rapid cooling apparatus 11 may include an exit-side upper gas ejection nozzle 61 (gas ejection nozzle) configured to eject a gas 611 such as air or nitrogen from the upper side on the exit side of the metal strip 1 onto the metal strip 1. The exit-side upper gas ejection nozzle 61 is configured to remove the remained fluid leaking from between the upper surface of the metal strip 1 and the upper cooling fluid removing roll 51. The metal-strip rapid cooling apparatus 11 may also include an exit-side lower gas ejection nozzle 62 (gas ejection nozzle) configured to eject a gas 622 such as air or nitrogen from the lower side on the exit side of the metal strip 1 onto the metal strip 1. The exit-side lower gas ejection nozzle 62 is configured to remove the remained fluid leaking from between the lower surface of the metal strip 1 and the lower cooling fluid removing roll 52.

The ejection directions of the upper cooling fluid ejection nozzles 21 and the lower cooling fluid ejection nozzles 22 are preferably inclined toward the travel direction of the metal strip 1 as illustrated in FIG. 1. That is, the ejection from the nozzles is preferably inclined such that the horizontal component of the ejection direction is the travel direction of the metal strip 1. This produces, in the jet flow, a flow accompanying the travel of the metal strip 1, improves adhesion of the cooling fluid to the metal strip 1, prevents disturbance of the jet flow, and makes it easier to keep the cooling length constant. To distribute the points of contact with water as uniformly as possible on the upper surface of the metal strip 1 and prevent unevenness of cooling in the longitudinal direction, it is preferable, when a plurality of sets of nozzles are arranged, that the upper cooling fluid ejection nozzles 21 be inclined in the same direction and at the same angle. Also, to distribute the points of contact with water as uniformly as possible on the lower surface of the metal strip 1 and prevent unevenness of cooling in the longitudinal direction, it is preferable, when a plurality of sets of nozzles are arranged, that the lower cooling fluid ejection nozzles 22 be inclined in the same direction and at the same angle.

As illustrated in FIG. 1, of the angles formed by the axial direction of the upper cooling fluid ejection nozzle 21 (cooling fluid ejection direction) and the metal strip 1, an acute angle 21*a* can be set as the inclination angle of the upper cooling fluid ejection nozzle 21. Although the cooling fluid is discharged from the nozzles in a spreading manner to some extent, the direction of the central axis of the cooling fluid discharged from the nozzles can be used as the cooling fluid ejection direction. The angle 21*a* can be set, for example, in accordance with the amount of the cooling fluid ejected from the upper cooling fluid ejection nozzle 21, and the distance between the opening of the upper cooling fluid ejection nozzle 21 and the upper surface of the metal strip 1. An inclination angle 22*a* of the lower cooling fluid ejection nozzle 22 can be set in a similar manner to that described above.

For example, the angle 21*a* and the angle 22*a* are preferably greater than or equal to 10°. Also, for example, the angle 21*a* and the angle 22*a* are preferably less than or equal to 60°. If the angle 21*a* and the angle 22*a* are greater than or equal to 10°, there is no need to bring the upper cooling fluid ejection nozzle 21 and the lower cooling fluid ejection nozzle 22 closer to the metal strip 1, and it is easy to secure space to install the upper movable masking plate 31 and the lower movable masking plate 32. If the angle 21*a* and the angle 22*a* are less than or equal to 60°, the remaining fluid can easily flow in the direction of conveyance of the metal strip. It is more preferable that the angle 21*a* and the angle 22*a* be greater than or equal to 20°. Also, it is more preferable that the angle 21*a* and the angle 22*a* be less than or equal to 45°. To allow the upper cooling fluid ejection nozzles 21 and the lower cooling fluid ejection nozzles 22 to be inclined, at least the tips of the upper cooling fluid ejection nozzles 21 and lower cooling fluid ejection nozzles 22 may each be simply inclined to eject the cooling fluid at an angle.

If the angle 21*a* and the angle 22*a* are equal when the upper cooling fluid ejection nozzles 21 and the lower cooling fluid ejection nozzles 22 are at the same distance to the metal strip 1, the position at which the cooling fluid reaches the metal strip 1 on the upper side may differ from that on the lower side due to the effect of gravity. When the effect of gravity is taken into account, it is preferable that the angle 22*a* be greater than the angle 21*a* (angle 21*a*<angle 22*a*).

The movable masking plates (the upper movable masking plate 31 and the lower movable masking plate 32) may be of any material and thickness as long as they are resistant to deformation under pressure of the cooling fluid. However, the upper movable masking plate 31 and the lower movable masking plate 32 may preferably be as thin as possible in consideration of space for installation of the nozzles. Since the movable masking plates are used to prevent the cooling fluid from colliding with the metal strip 1 such as a steel strip, the movable masking plates are to be greater in width than the metal strip 1. To control the cooling start position (i.e., the position at which jet flows from the entry-side upper gas ejection nozzle 41 and the entry-side lower gas ejection nozzle 42 collide with the metal strip 1), the movable masking plates are to be movable in the longitudinal direction (horizontal direction).

With the metal-strip rapid cooling apparatus 11, which includes the movable masking plates described above, it is possible to control the finish cooling temperature at low cost without using, for example, a special ionic liquid.

The ejection directions of the gas ejection nozzles (the entry-side upper gas ejection nozzle 41 and the entry-side lower gas ejection nozzle 42) attached to the movable masking plates are preferably inclined toward the travel direction of the metal strip 1 as illustrated in FIG. 1. That is, the ejection from the nozzles is preferably inclined such that the horizontal component of the ejection direction is the travel direction of the metal strip 1. It is more preferable that an inclination angle 41*a* of the entry-side upper gas ejection nozzle 41 be equal or substantially equal to the angle 21*a*, and that an inclination angle 42*a* of the entry-side lower gas ejection nozzle 42 be equal or substantially equal to the angle 22*a*. This makes it easier to prevent the remaining fluid from flowing back to the position of the upper movable masking plate 31 and the lower movable masking plate 32.

The cooling fluid removing rolls are configured to hold the metal strip 1 between the upper cooling fluid removing roll 51 and the lower cooling fluid removing roll 52 to remove the remained fluid on the metal strip 1.

It is preferable that the cooling fluid removing rolls (the upper cooling fluid removing roll 51 and the lower cooling fluid removing roll 52) be made of rubber, and it is particularly preferable that they be made of polyurethane rubber. The roll diameter is preferably greater than or equal to 100 mm. Also, the roll diameter is preferably less than or equal to 400 mm. The nip pressure is preferably greater than or equal to 5 kg/cm. Also, the nip pressure is preferably less than or equal to 20 kg/cm. The cooling fluid removing rolls may be non-drive rolls, but it is preferable that they be drive rolls.

The ejection directions of the gas ejection nozzles (the exit-side upper gas ejection nozzle 61 and the exit-side lower gas ejection nozzle 62) disposed on the exit side of the cooling fluid removing rolls are preferably inclined toward the direction opposite the travel direction of the metal strip 1 as illustrated in FIG. 1. That is, the ejection from the nozzles is preferably inclined such that the horizontal component of the ejection direction is the direction opposite the travel direction of the metal strip 1. This facilitates removal of the remained fluid such as remained water leaking from the cooling fluid removing rolls.

For example, an inclination angle 61*a* of the exit-side upper gas ejection nozzle 61 (i.e., the angle formed by the ejection direction of a gas ejected from the nozzle 61 and the metal strip 1) and an inclination angle 62*a* of the exit-side lower gas ejection nozzle 62 (i.e., the angle formed by the ejection direction of a gas ejected from the nozzle 62 and the metal strip 1) are preferably greater than or equal to 5°. Also, for example, the inclination angle 61*a* and the inclination angle 62*a* are preferably less than or equal to 80°. If the angle 61*a* and the angle 62*a* are greater than or equal to 5°, the ejection direction is prevented from being substantially parallel to the travel direction of the metal strip 1 and it is possible to further improve the removing capability. If the angle 61*a* and the angle 62*a* are less than or equal to 80°, the ejection direction is prevented from being substantially perpendicular to the travel direction of the metal strip 1 and it is possible to further improve the removing capability. It is more preferable that the angle 61*a* and the angle 62*a* be greater than or equal to 20°. Also, it is more preferable that the angle 61*a* and the angle 62*a* be less than or equal to 45°.

The temperature of a gas such as air or nitrogen to be ejected is preferably higher than or equal to 10° C. Also, the temperature of a gas such as air or nitrogen to be ejected is preferably lower than or equal to 30° C. The ejection pressure is preferably greater than or equal to 0.2 MPa. Also, the ejection pressure is preferably less than or equal to 1.0 MPa.

A cooling length b (mm), which is the distance from the cooling start position to the cooling stop position (i.e., the position at which the upper cooling fluid removing roll 51 and the lower cooling fluid removing roll 52 are in contact with the metal strip 1), is preferably set on the basis of a line speed v (mm/s), a thickness t (mm) of the metal strip 1, a cooling start temperature $T_1$ (° C.), a target finish cooling temperature $T_2$ (° C.), and a cooling rate CV (° C./s) of the metal strip 1.

The cooling start temperature $T_1$ (° C.) is the temperature of the metal strip 1 at the cooling start position and the finish cooling temperature $T_2$ (° C.) is the temperature of the metal strip 1 at the cooling stop position.

Since the values described above have the relation expressed by equation (1), the distance b (mm) can be expressed by equation (2):

$$CV=(T_1-T_2)/(b/v) \quad (1),$$

$$b=(T_1-T_2)v/CV \quad (2).$$

The cooling rate CV can be expressed by equation (3) using a constant α (° C.·mm/s) determined in accordance with cooling conditions (e.g., nozzle shape, temperature and type of cooling fluid to be ejected (the water 211 and the water 222 here), and the amount of ejection) and the thickness t of the metal strip 1:

$$CV=\alpha/t \quad (3).$$

For example, in the metal strip 1 with a thickness t=1 mm to 2 mm, the cooling rate CV can be expressed by equation (4), or can be expressed by equation (5) using the intermediate value:

$$CV=1000/t \text{ to } 2000/t(° \text{ C./s}) \quad (4),$$

$$CV=1500/t \ (° \text{ C./s}) \quad (5).$$

This means that a can be expressed by equation (6) or (7):

$$\alpha=1000 \text{ to } 2000 \ (° \text{ C.·mm/s}) \quad (6),$$

$$\alpha=1500 \ (° \text{ C.·mm/s}) \quad (7).$$

Accordingly, equation (2) can be expressed by equation (8):

$$b=(T_1-T_2)vt/\alpha \quad (8).$$

The cooling rate CV (° C./s) and α (° C.·mm/s) may be determined in advance, for example, by experiments or numerical analyses and compiled into a database or expressed in the form of formulas.

The example described above is applicable to production of a metal strip product (i.e., metal strip shipped as a product). It is particularly preferable to apply the example to production of a steel strip such as a high-strength cold-rolled steel strip or a hot-dip galvanized steel strip.

More specifically, it is preferable to apply the example to production of a steel strip with a tensile strength of greater than or equal to 580 MPa. The upper limit of the tensile strength may be any value, but may be, for example, less than or equal to 1600 MPa.

The high-strength cold-rolled steel strip or the hot-dip galvanized steel strip contains, for example, C of greater than or equal to 0.04% and less than or equal to 0.25% by mass, Si of greater than or equal to 0.01% and less than or equal to 2.50% by mass, Mn of greater than or equal to 0.80% and less than or equal to 3.70% by mass, P of greater than or equal to 0.001% and less than or equal to 0.090% by mass, S of greater than or equal to 0.0001% and less than or equal to 0.0050% by mass, soluble Al of greater than or equal to 0.005% and less than or equal to 0.065% by mass, at least one of Cr, Mo, Nb, V, Ni, Cu, and Ti of less than or equal to 0.5% by mass as necessary, and Fe and incidental impurities constituting the remainder. This composition may further contain both B and Sb of less than or equal to 0.01% by mass, as necessary.

Applying the example to production of an electrogalvanized steel strip and an alloyed hot-dip galvanized steel strip is as preferable as applying the example to production of the high-strength cold-rolled steel strip and the hot-dip galvanized steel strip.

In the example as described above, the temperature of the metal strip 1 after rapid cooling can always be controlled, regardless of the conditions of producing the metal strip 1 (e.g., line speed v).

Although the example has been described on the assumption that the steel strip is rapidly cooled with water, this disclosure is generally applicable to cooling of metal strips of various types other than steel strips, and is applicable to rapid cooling using coolants of various types other than water.

EXAMPLES

An example will now be described.

As an Invention Example, our rapid cooling apparatus illustrated in FIG. 1 was used.

The angle 21*a* was 30°, the angle 22*a* was 40°, the angle 41*a* was 30°, the angle 42*a* was 40°, the angle 61*a* was 30°, and the angle 62*a* was 30°.

The temperature of air (used as a gas to be ejected) was 20° C. and the ejection pressure was 0.6 MPa. The roll diameter was 200 mm and the nip pressure was 10 kg/cm.

With the apparatus described above, a high-strength hot-dip galvanized steel strip with a thickness t of 1.0 mm, a width of 1000 mm, and a tensile strength of 1470 MPa grade was produced. The line speed v was 500 mm/s to 3000 mm/s, the cooling start temperature $T_1$ was 400° C., and the target finish cooling temperature $T_2$ was 100° C. The water temperature was 30° C., and the cooling rate a/t was set to 1500/t (° C./s) on the basis of preliminary measurement and equation (5) described above.

The cooling length b (mm) from the cooling start position to the cooling stop position was controlled to satisfy b=100 mm to 600 mm on the basis of equation (8) described above.

As Comparative Example 1, on the other hand, the cooling apparatus described in JP '843 was used to produce the high-strength hot-dip galvanized steel strip described above under the same conditions as those in the Invention Example.

As Comparative Example 2, the cooling apparatus described in JP '282 was used to produce the high-strength hot-dip galvanized steel strip described above under the same conditions as those in the Invention Example.

As Comparative Example 3, the cooling apparatus described in JP '733 was used to produce the high-strength hot-dip galvanized steel strip described above under the same conditions as those in the Invention Example.

As Comparative Example 4, the cooling apparatus described in JP '515 was used to produce the high-strength hot-dip galvanized steel strip described above under the same conditions as those in the Invention Example.

For each of the examples (the Invention Example and Comparative Examples 1 to 4), the relation between the line speed v (mm/s) and the finish cooling temperature $T_2$ (° C.) was examined.

Figure 2:
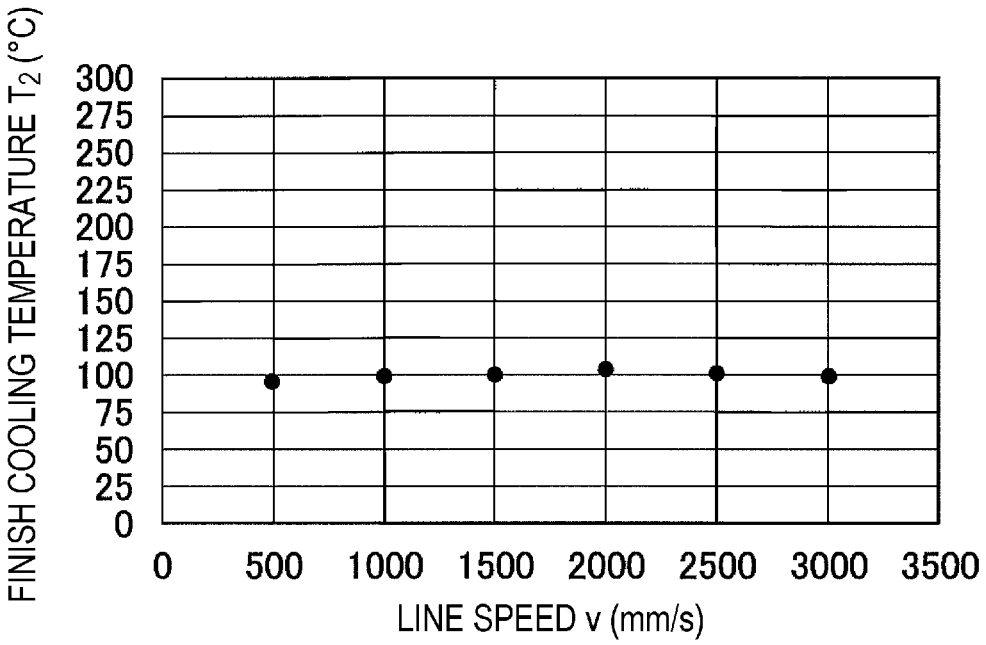
FIG. 2 is a graph showing a result (finish cooling temperature) of an Invention Example.
Figure 3:
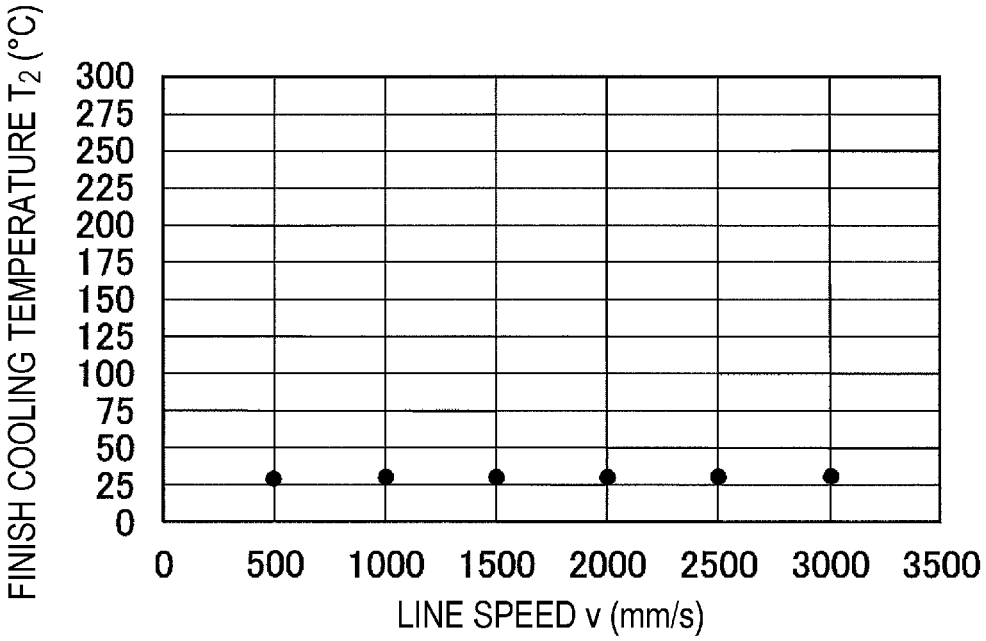
FIG. 3 is a graph showing a result (finish cooling temperature) of Comparative Example 1.
Figure 4:
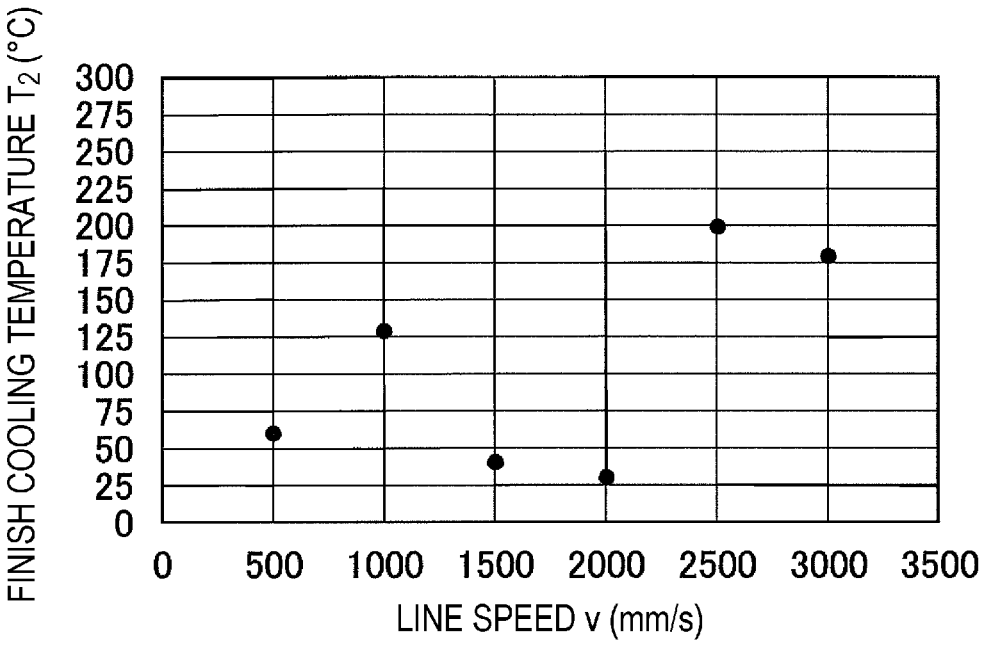
FIG. 4 is a graph showing a result (finish cooling temperature) of Comparative Example 2.
Figure 5:
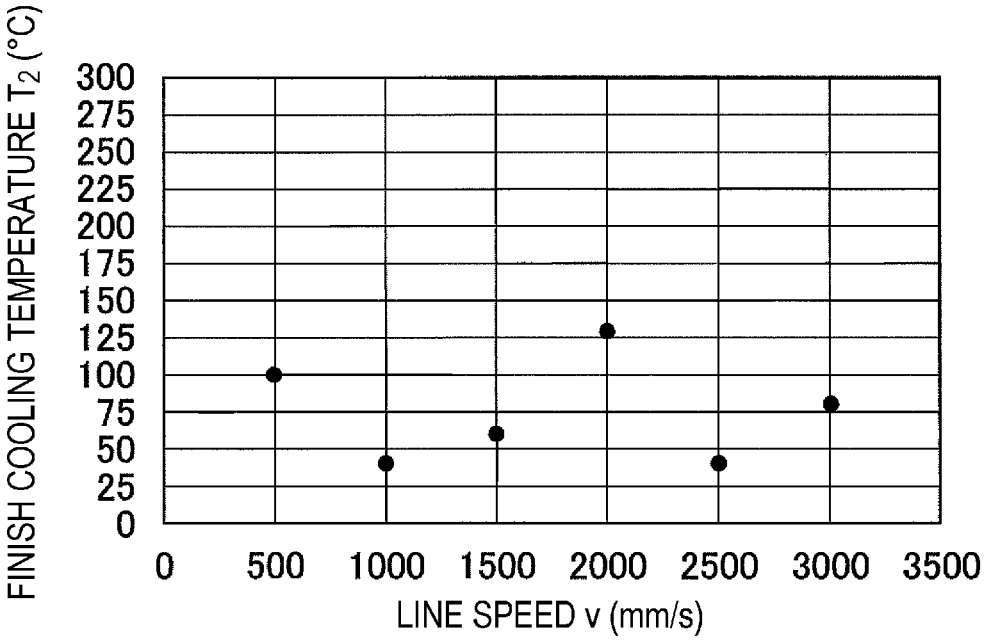
FIG. 5 is a graph showing a result (finish cooling temperature) of Comparative Example 3.
Figure 6:
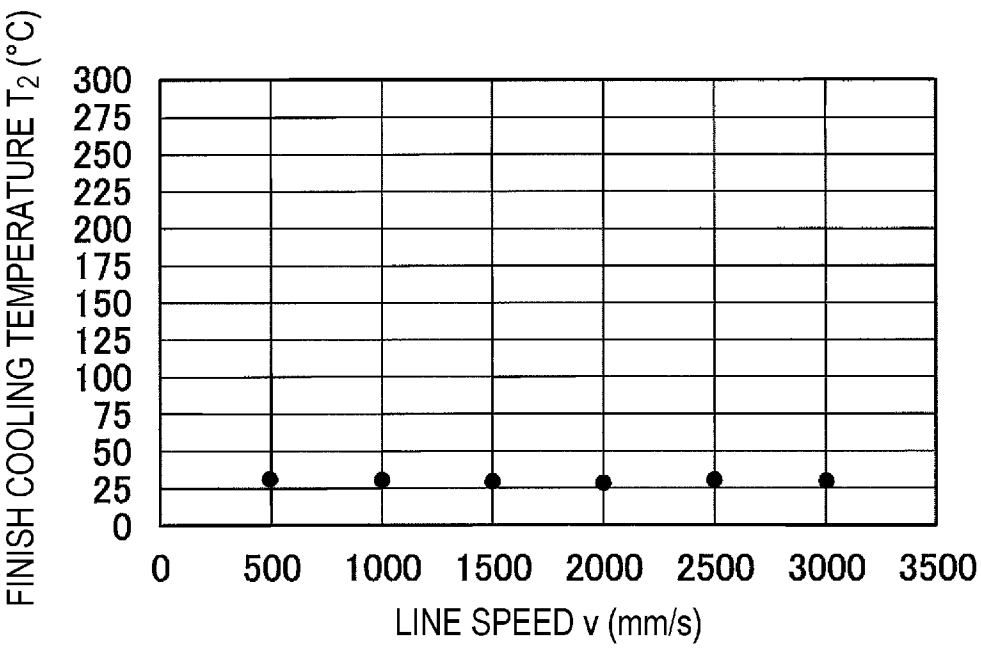
FIG. 6 is a graph showing a result (finish cooling temperature) of Comparative Example 4.

FIG. 2 shows the result of the Invention Example, FIG. 3 shows the result of Comparative Example 1, FIG. 4 shows the result of Comparative Example 2, FIG. 5 shows the result of Comparative Example 3, and FIG. 6 shows the result of Comparative Example 4.

In Comparative Example 1 and Comparative Example 4, as shown in FIGS. 3 and 6, the finish cooling temperature $T_2$ (° C.) was substantially the same as the water temperature (30° C.) regardless of the line speed v (mm/s), and was unable to be controlled to the target finish cooling temperature $T_2$.

Specifically, in Comparative Example 1, unlike in the Invention Example, the steel strip was immersed in water in the water tank for cooling. The temperature of the steel strip after rapid cooling was thus equal to the water temperature, and the finish cooling temperature $T_2$ was unable to be controlled.

Unlike the Invention Example, Comparative Example 4 used a technique which involves using a water ejection device and an air ejection device disposed above a steel strip to remove remained water on the upper surface of the steel strip with wiping water. Removing the remained water required ejection of high-pressure water. By using the wiping water, the temperature of the steel strip was lowered to the water temperature, and the finish cooling temperature $T_2$ was unable to be controlled.

In Comparative Example 2 and Comparative Example 3 as shown in FIGS. 4 and 5, the finish cooling temperature $T_2$ (° C.) varied significantly depending on the line speed v (mm/s) and was unable to be controlled.

Specifically, unlike the Invention Example, Comparative Example 2 used a technique in which in a vertical path along which the steel strip is moved upward, rapid heating is performed after rapid cooling to keep the finish cooling temperature constant. In this instance, gravity caused water to leak from the rolls in the lower part of the cooling apparatus. The cooling start position and the finish cooling temperature $T_2$ were thus unable to be controlled.

Unlike the Invention Example, Comparative Example 3 used a technique involving removing remained water using only gas nozzles without using cooling fluid removing rolls. This was not effective enough to either control the cooling start position or remove the remained water. The finish cooling temperature $T_2$ was thus unable to be controlled.

In contrast, in the Invention Example, as shown in FIG. 2, the finish cooling temperature $T_2$ (° C.) was able to be controlled within the 100±5° C. range, regardless of the conditions of producing the steel strip such as the line speed v (mm/s).

The effectiveness of our apparatus and methods was thus confirmed.

The invention claimed is:

1. A metal-strip rapid cooling apparatus configured to cool a metal strip while conveying the metal strip in a horizontal direction, the metal-strip rapid cooling apparatus comprising:

a cooling fluid ejection device including one set of nozzles or a plurality of sets of nozzles arranged in the horizontal direction, the nozzles configured to eject a cooling fluid onto the metal strip from both sides of the metal strip;

cooling fluid removing rolls configured to remove a remaining fluid from the metal strip onto which the cooling fluid has been ejected; and movable masking plates disposed on both sides of a metal strip pass line along which the metal strip passes, the movable masking plates each disposed between the metal strip pass line and the nozzles, the movable masking plates configured to move in the horizontal direction to adjust a cooling start position and control a distance from the cooling start position to the cooling fluid removing rolls, the cooling start position being a position at which the metal strip starts to be cooled with the cooling fluid.

2. The metal-strip rapid cooling apparatus according to claim 1, further comprising gas ejection nozzles disposed on a exit side of the cooling fluid removing rolls.

3. The metal-strip rapid cooling apparatus according to claim 1, wherein the movable masking plates each have a gas ejection nozzle attached thereto.

4. The metal-strip rapid cooling apparatus according to claim 1, wherein an angle formed by the metal strip and an axial direction of each of the nozzles ejecting the cooling fluid is greater than or equal to 10° and less than or equal to 60°.

5. The metal-strip rapid cooling apparatus according to claim 2, wherein the movable masking plates each have a gas ejection nozzle attached thereto.

6. The metal-strip rapid cooling apparatus according to claim 2, wherein an angle formed by the metal strip and an axial direction of each of the nozzles ejecting the cooling fluid is greater than or equal to 10° and less than or equal to 60°.

7. The metal-strip rapid cooling apparatus according to claim 3, wherein an angle formed by the metal strip and an axial direction of each of the nozzles ejecting the cooling fluid is greater than or equal to 10° and less than or equal to 60°.

8. The metal-strip rapid cooling apparatus according to claim 5, wherein an angle formed by the metal strip and an axial direction of each of the nozzles ejecting the cooling fluid is greater than or equal to 10° and less than or equal to 60°.

* * * * *